US007436283B2

(12) United States Patent
Babic et al.

(10) Patent No.: US 7,436,283 B2
(45) Date of Patent: Oct. 14, 2008

(54) MECHANICAL REINFORCEMENT STRUCTURE FOR FUSES

(75) Inventors: Tomas I. Babic, Allegany, NY (US); Roger S. Perkins, Allegany, NY (US); Michael M. Ramarge, Olean, NY (US); David P. Bailey, Portville, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/716,543

(22) Filed: Nov. 20, 2003

(65) Prior Publication Data

US 2005/0110607 A1 May 26, 2005

(51) Int. Cl.
*H01H 85/17* (2006.01)

(52) U.S. Cl. ..... 337/187; 337/186; 29/623

(58) Field of Classification Search ..... 337/187, 337/186; 29/623
See application file for complete search history.

(56) References Cited

U.S. PATENT DOCUMENTS

| | | | | | |
|---|---|---|---|---|---|
| 2,929,900 | A | * | 3/1960 | White | 337/246 |
| 3,111,567 | A | * | 11/1963 | Stewart et al. | 337/279 |
| 3,846,727 | A | * | 11/1974 | Harmon | 337/246 |
| 3,913,127 | A | | 10/1975 | Suzuki et al. | |
| 3,979,709 | A | * | 9/1976 | Healey, Jr. | 337/186 |
| 3,983,525 | A | * | 9/1976 | Healey, Jr. | 337/186 |
| 3,984,800 | A | * | 10/1976 | Healey, Jr. | 337/186 |
| 3,986,157 | A | * | 10/1976 | Salzer et al. | 337/186 |
| 3,986,158 | A | * | 10/1976 | Salzer | 337/246 |
| 4,028,656 | A | * | 6/1977 | Schmunk et al. | 337/186 |
| 4,104,604 | A | * | 8/1978 | George | 337/248 |
| 4,272,411 | A | | 6/1981 | Sokoly et al. | |
| 4,282,504 | A | * | 8/1981 | Tobin | 337/186 |
| 4,282,557 | A | | 8/1981 | Stetson | |
| 4,296,002 | A | | 10/1981 | Sokoly et al. | |
| 4,313,100 | A | * | 1/1982 | Schmunk | 337/168 |
| 4,349,803 | A | * | 9/1982 | Tobin | 337/186 |
| 4,352,140 | A | | 9/1982 | Axelsson et al. | |
| 4,388,603 | A | | 6/1983 | Hassler et al. | |
| 4,404,614 | A | | 9/1983 | Koch et al. | |
| 4,444,351 | A | | 4/1984 | Dries et al. | |
| 4,456,942 | A | | 6/1984 | Bronikowski | |
| 4,656,555 | A | | 4/1987 | Raudabaugh | |
| 4,729,053 | A | | 3/1988 | Maier et al. | |
| 4,780,598 | A | | 10/1988 | Fahey et al. | |
| 4,825,188 | A | | 4/1989 | Parraud et al. | |
| 4,833,438 | A | | 5/1989 | Parraud et al. | |
| 4,851,955 | A | | 7/1989 | Doone et al. | |

(Continued)

FOREIGN PATENT DOCUMENTS

| | | |
|---|---|---|
| DE | 3 334 533 | 4/1985 |

(Continued)

*Primary Examiner*—Anatoly Vortman
(74) *Attorney, Agent, or Firm*—Fish & Richardson P.C.

(57) ABSTRACT

A fuse includes an electrical assembly and a fuse tube assembly. The electrical assembly has two electrical contacts accessible from the exterior of the fuse and a fuse element in contact with the two electrical contacts. The fuse tube assembly includes a support structure surrounding at least a portion of the electrical assembly and a reinforcing structure formed over the support structure and in contact with at least a portion of the electrical assembly. The reinforcing structure is made of a fiber matrix pre-impregnated with a resin.

13 Claims, 8 Drawing Sheets

U.S. PATENT DOCUMENTS

| | | | | |
|---|---|---|---|---|
| 4,899,248 | A | | 2/1990 | Raudabaugh |
| 4,918,420 | A | * | 4/1990 | Sexton ..... 337/205 |
| 4,962,440 | A | | 10/1990 | Johnnerfelt et al. |
| 4,992,906 | A | | 2/1991 | Doone et al. |
| 5,003,689 | A | | 4/1991 | Doone et al. |
| 5,008,646 | A | | 4/1991 | Hennings et al. |
| 5,043,838 | A | | 8/1991 | Sakich |
| 5,047,891 | A | | 9/1991 | Nedriga |
| 5,128,824 | A | | 7/1992 | Yaworski et al. |
| 5,159,748 | A | | 11/1992 | Doone et al. |
| 5,218,508 | A | | 6/1993 | Doone |
| 5,220,480 | A | | 6/1993 | Kershaw, Jr. et al. |
| 5,225,265 | A | | 7/1993 | Prandy et al. |
| 5,237,482 | A | | 8/1993 | Osterhout et al. |
| 5,261,980 | A | * | 11/1993 | Pearce ..... 156/173 |
| 5,291,366 | A | | 3/1994 | Giese et al. |
| 5,313,184 | A | | 5/1994 | Greuter et al. |
| 5,363,266 | A | | 11/1994 | Wiseman et al. |
| 5,497,138 | A | | 3/1996 | Malpiece et al. |
| 5,570,264 | A | | 10/1996 | Lundquist et al. |
| 5,602,710 | A | | 2/1997 | Schmidt et al. |
| 5,608,597 | A | | 3/1997 | Holmström et al. |
| 5,652,690 | A | | 7/1997 | Mansfield et al. |
| 5,912,611 | A | | 6/1999 | Berggren et al. |
| 5,923,518 | A | | 7/1999 | Hensley |
| 5,926,356 | A | | 7/1999 | Sakich et al. |
| 5,930,102 | A | | 7/1999 | Rook |
| 5,936,826 | A | | 8/1999 | Schmidt |
| 5,959,822 | A | | 9/1999 | Bock et al. |
| 5,990,778 | A | | 11/1999 | Strümpler et al. |
| 6,008,975 | A | | 12/1999 | Kester et al. |
| 6,008,977 | A | | 12/1999 | Thatcher |
| 6,185,813 | B1 | | 2/2001 | Donnola |
| 6,279,811 | B1 | | 8/2001 | Ramarge et al. |
| 6,396,676 | B1 | | 5/2002 | Doone et al. |

FOREIGN PATENT DOCUMENTS

| | | |
|---|---|---|
| EP | 0 642 141 | 3/1995 |
| JP | 03-034522 | 2/1991 |
| JP | 11-340635 | 12/1999 |
| WO | WO 99/08353 | 2/1999 |
| WO | WO 99/18642 | 4/1999 |

* cited by examiner

MECHANICAL REINFORCEMENT STRUCTURE FOR FUSES

TECHNICAL FIELD

The following description relates to fuses, and more particularly to a mechanical reinforcement structure for fuses.

BACKGROUND

Electrical equipment typically is supplied with electric current values that remain within a fairly narrow range under normal operating conditions. However, momentary or extended current levels may be produced that greatly exceed the levels supplied to the equipment during normal operating conditions. These current variations often are referred to as over-current or fault conditions.

If not protected from over-current or fault conditions, critical and expensive equipment may be damaged or destroyed. Accordingly, it is routine practice for system designers to use a current limiting fuse to protect system components from dangerous over-current or fault conditions.

A current limiting fuse is a protective device that commonly is connected in series with a comparatively expensive piece of electrical equipment so as to protect the equipment and its internal circuitry from damage. When exposed to an over-current condition or fault, the fuse melts or otherwise creates an open circuit. In normal operation, the fuse acts as a conductor of current.

Conventional fuses typically include an elongated outer enclosure or housing made of an electrically insulating material, a pair of electrical terminals at opposite ends of the enclosure for connecting the fuse in series with a conductor, and one or more other electrical components that form a series electrical path between the terminals. These components typically include a fuse element (also called a spider assembly) that will melt or otherwise produce an open circuit upon the occurrence of an over-current or fault situation. The housing of the fuse is constructed so as to withstand the anticipated operating environment and typically is expected to last approximately 20 to 25 years. A filament-wound epoxy tube contains the fuse element and is painted with ultraviolet (UV) inhibiting paint in order to offer UV protection to the tube material, which would otherwise degrade more quickly over time with exposure to a UV source such as sunlight. The fuse element is placed inside the tube and a bonding material such as an epoxy is used to bond the electrical contacts to the inside wall of the fuse tube. Typically, the housing is a prefabricated unit into which the fuse element is inserted. The resulting assembly is then cured during a curing operation in order to harden the epoxy. This method of producing a fuse tends to be expensive because, among other things, special manufacturing techniques are needed for the curing operation. For example, the curing operation requires special equipment and procedures in order to keep the working area clean or else the fuse will not be properly sealed.

Also, centerless grinding of the tube is required in order to produce a uniform surface to receive the electrode. The surface at the end of the tube needs to be uniform and smooth in order to facilitate proper bonding of the tube, the fuse element, and the electrode during the curing operation. The centerless grinding operation tends to be expensive, as is the curing operation and the painting operation using UV resistant paint. Additionally, the pre-formed tube must have a wall with sufficient thickness to provide adequate burst strength and cantilever strength for the fuse. A thicker wall generally results in a higher cost.

An improper seal leads to moisture penetrating the interior of the fuse, which, in turn, leads to early fuse failure. There are two techniques commonly used to seal the ends of the tube. The first technique, described above, uses a curing operation to seal the ends. The second technique, known as magnaforming, uses a magnetic field to crimp the ends. These methods of sealing may lead to problems with leakage and intrusion of moisture into the interior of the fuse.

SUMMARY

In one general aspect, a fuse includes an electrical assembly and a fuse tube assembly. The electrical assembly has two electrical contacts accessible from the exterior of the fuse and a fuse element in contact with the two electrical contacts. The fuse tube assembly includes a support structure surrounding at least a portion of the electrical assembly and a reinforcing structure formed over the support structure and in contact with at least a portion of the electrical assembly. The reinforcing structure is made of a fiber matrix pre-impregnated with a resin.

Implementations may include one or more of the following features. For example, the fuse may be a current limiting fuse. In one implementation, the fuse element and/or the fuse tube assembly extends between the contacts. The inside surface of the support structure overlaps a portion of the outside surface of each of the electrical contacts.

In another implementation, the fiber matrix is a pre-woven fabric. The fibers in the pre-woven fabric are oriented in a predetermined orientation. The support structure may be a pre-formed tubular structure, and may be made from a composite material. The pre-formed tubular structure may include a slit from a first end of the structure to a second end of the structure. The thickness of the support structure is greater than the thickness of the reinforcing structure.

In one implementation, the fiber matrix is applied circumferentially. For example, the fiber matrix may be applied circumferentially such that the fibers have a predetermined orientation at a predetermined angle with respect to an axis of the fuse.

In another implementation, the fiber matrix is applied vertically. The vertical application may include at least one piece of fiber matrix placed in a vertical orientation along an axis of the fuse, or the vertical application may include a single piece of fiber matrix having a sufficient width to cover the majority of the outer surface of the fuse placed in a vertical orientation along an axis of the fuse.

In another implementation, the reinforcing structure includes at least one layer of pre-impregnated fiber matrix applied circumferentially and at least one layer of pre-impregnated fiber matrix applied vertically.

The reinforcing structure may be configured to reinforce a selected portion of an area of the fuse along a lengthwise axis of the fuse. The selected portion of the area may be less than all of the area, and may be an area excluding a portion of the outside surface of the electrical assembly.

The fuse tube assembly may include a heat shrink structure formed over the reinforcing structure. The heat shrink structure may be constructed of a material providing UV protection. The heat shrink structure may be a pre-formed sleeve or may include one or more strips of a heat shrink tape.

In another general aspect, a fuse is reinforced by providing an electrical assembly having two electrical contacts accessible from the exterior of the fuse and a fuse element in contact with the two electrical contacts, surrounding at least a portion of the electrical assembly by a support structure, and applying a reinforcing structure over the support structure.

The reinforcing structure is in contact with at least a portion of the electrical assembly and is made from a fiber matrix including fibers pre-impregnated with a resin.

Implementations may include one or more of the following features. For example, a heat shrink structure may be applied over the reinforcing structure. In one implementation, the reinforcing structure is applied by applying the pre-impregnated fiber matrix in a rolling operation. In another implementation, the reinforcing structure is applied by applying the pre-impregnated fiber matrix in a wrapping operation. The pre-impregnated fiber matrix may be applied circumferentially and/or vertically.

In another implementation, post application processing of the fuse is performed. Post application processing may include curing by, for example, heating the fuse to between approximately 250° F. and 400° F. Post application processing also may include pre-heating the electrical assembly to a temperature between, for example, approximately 100° F. and 200° F. Post application processing also may include filling the fuse with an electrical arc quenching medium.

In another general aspect, a current limiting fuse includes an electrical assembly and a fuse tube assembly. The electrical assembly includes two electrical contacts accessible from the exterior of the fuse and a fuse element in contact with the two electrical contacts. The fuse tube assembly includes a support structure surrounding at least a portion of the electrical assembly and a reinforcing structure formed over the support structure. The reinforcing structure is made of a resin composition of discontinuous fibers arbitrarily dispersed in an epoxy.

Other features will be apparent from the description, the drawings, and the claims.

DETAILED DESCRIPTION

Figure 1:
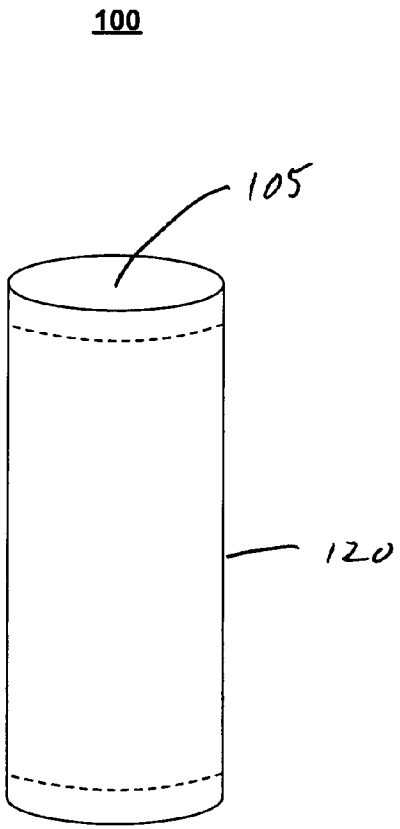
FIG. 1 is a perspective view of a fuse with a mechanical reinforcement structure.

Techniques are provided for producing a fuse, such as a current limiting fuse, with a mechanical reinforcement structure. The mechanical reinforcement structure uses a material that is pre-impregnated with resin and is referred to as a "pre-preg" material. The fuse may be employed in multiple applications such as, for example, high voltage applications. In one implementation, the fuse is used in high voltage applications that employ voltages from approximately 3.7 kV to approximately 37 kV. In other implementations, the fuse may be used in lower voltage applications. The fuse may be a low AC current or a high AC current fuse. Typically, the fuse may be designed to withstand normal operating currents from approximately 1.5 amps to approximately 100 amps. Other applications are possible. For example, the fuse may be designed to carry a normal operating current up to approximately 200 or 300 amps. In one implementation, the fuse may be designed to carry from approximately 25 amps to approximately 100 amps. Other values may be used for the design of the fuse.

Referring to FIG. 1, a fuse 100 includes an electrical contact/fuse element assembly 105 and a fuse tube assembly 120. The electrical contact/fuse element assembly 105 may have a threaded bolt hole (not shown) or other mechanism to make an electrical connection between the fuse 100 and a conductor in order to employ the fuse in an electric circuit.

Figure 2:
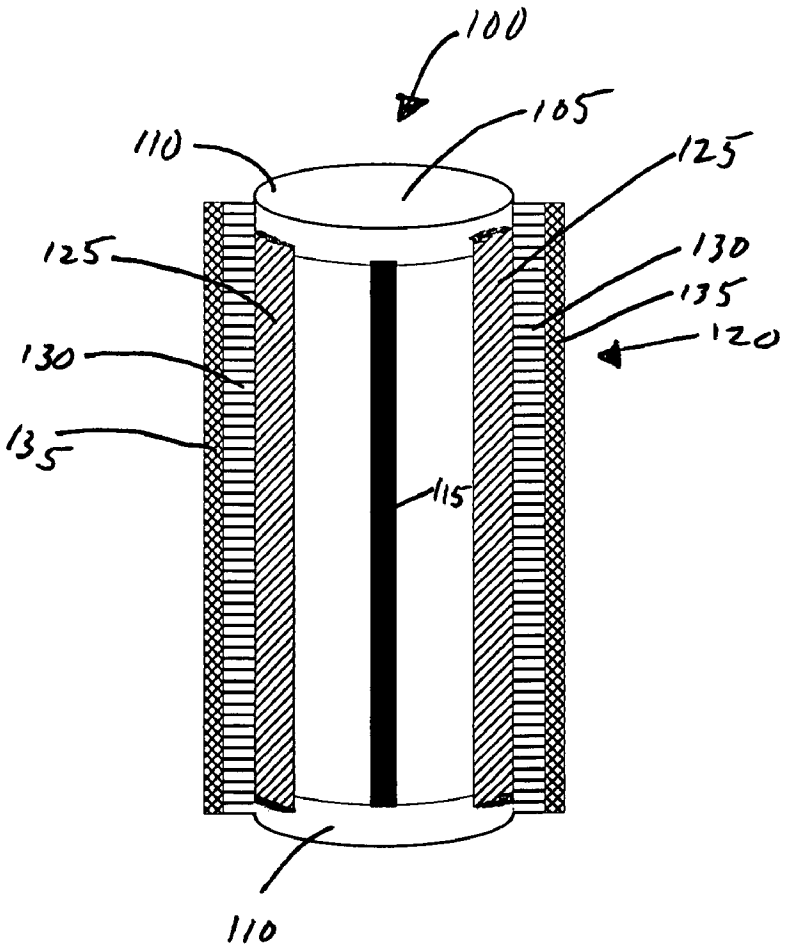
FIG. 2 is a perspective cross-sectional view of the fuse of FIG. 1.

As shown in FIG. 2, the electrical contact/fuse element assembly 105 includes electrical contacts 110 and a fuse element 115. An electrical contact 110 is provided at each end of the fuse 100 and the fuse element 115 is connected between the two electrical contacts 110. As shown, the fuse element 115 is contained in a fuse tube assembly 120 that includes a support structure 125, a reinforcing structure 130, and an optional heat shrink structure 135. The heat shrink structure may be made of a suitable heat shrink material such as a polyolefin.

The tube assembly 120 may be filled with an electrical arc quenching medium 140, such as sand or another dielectric. In one implementation, the electrical arc quenching medium 140 may be air or a different gas such as, for example, SS6 gas.

The support structure 125 surrounds a portion the electrical contact/fuse element assembly 105 and provides a mechanical structure on which the reinforcing structure 130 may be applied. A portion of the inside surface of the support structure 125 overlaps a portion of an outside surface of the electrical assembly 105, such as an outside portion of the electrical contact 110. The support structure 125 overlaps less than all of the electrical assembly 105. For example, the support structure may overlap the electrical contact by 60 thousandths of an inch. Other overlap distances may be used.

The support structure 125 prevents the reinforcing structure 130 from collapsing before being hardened in a curing operation. The reinforcing structure 130 is formed over the support structure 125 and is in direct physical contact with a portion of the electrical assembly 105, such as an outside surface of an electrical contact 110. Because the support structure 125 is merely providing a mechanical support around which the reinforcing structure 130 is applied, the support structure 125 may be relatively thin and need not have any additional preparation, such as a centerless ground surface to receive the electrical contacts 110. The thickness of the support structure 125 may be, for example 10 thousandths of an inch, 20 thousandths of an inch, or 30 thousandths of an inch. The thickness of the support structure 125 is normally greater than the thickness of the reinforcing structure 130. For example, in one implementation, the support structure has a thickness of 25 thousandths of an inch and the reinforcing structure has a thickness of 20 thousandths of an inch. However, other thickness values may be used. In general, a thinner support structure is a less expensive to manufacture.

Figure 3:
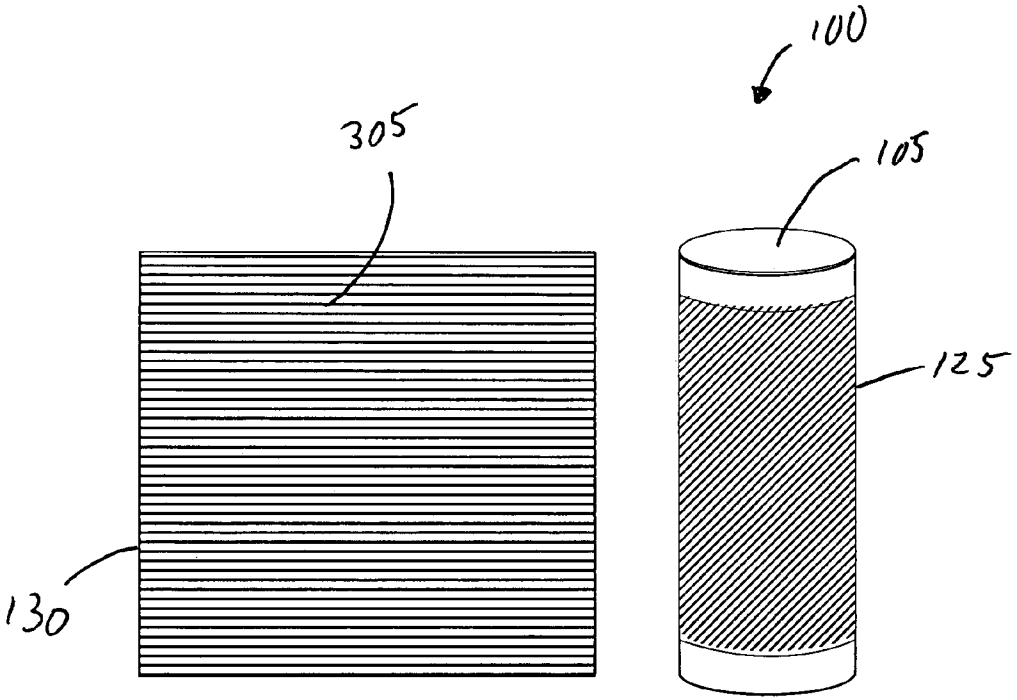
FIGS. 3 and 4 are plan views of reinforcing structures applied to the fuse of FIG. 1.

FIG. 3 shows one implementation of the application of the reinforcing structure 130 to the support structure 125. As shown in FIG. 3, the reinforcing structure 130 is wrapped around the supporting structure 125. In one implementation, the support structure 125 is rotated and the reinforcing structure 130 is wound onto the support structure 125 in a winding operation.

The reinforcing structure 130 typically is applied to the outer surface of support structure 125. The reinforcing structure 130 may include at least one layer of a pre-impregnated fiber matrix 305 (i.e., pre-preg material). The fiber matrix 305 may be a woven or interwoven fabric, sheet or strip. In other implementations, the fiber matrix 305 may take other forms, such as, for example, a collection of fiber segments. The fiber matrix 305 may encompass various form factors, and may be narrow or wide as needed to reinforce the fuse 100. The fiber matrix 305 typically has a pre-formed woven or interwoven pattern. The fiber matrix 305 is pre-impregnated with resin, and is applied to the support structure 125 as desired. The pre-impregnated fiber matrix 305 typically has fibers oriented in a pre-determined orientation per the woven or interwoven pattern. Implementations include fibers oriented to be parallel, perpendicular or at other angles with respect to an axis of the pre-preg material according to the woven or interwoven pattern. Another implementation includes fibers that are arbitrarily oriented. The length of the fibers in the pre-impregnated fiber matrix 305 may be predetermined or arbitrary. Implementations include fibers that are, for example, continuous, of at least one predetermined length, or arbitrary in length. The fiber matrix 305 typically is pre-impregnated with resin. The matrix 305 may be, for example, dipped, cast, powder cast, or otherwise pre-impregnated. The fibers are made of an insulating fibrous material such as, for example, fiberglass, Kevlar, or Nextel.

The fiber matrix 305 generally is circumferentially-applied fiber with fibers oriented at a predetermined angle. The predetermined angle typically includes consideration of both the angle of the fibers with respect to the reinforcing material discussed above, and the angle of the reinforcing material with respect to an axis of the fuse. The pattern may be, for example, a back and forth wind pattern, a circular wind pattern, or another woven or interwoven pattern. The fiber matrix 305 may be applied to the support structure 125 in one or more layers such that the reinforcing structure 130 has a predetermined thickness. The predetermined angle of the fibers typically is a shallow angle, but may include other angles. The circumferentially-applied matrix may also be applied vertically or may be combined with, for example, a vertically-applied matrix and/or a fiber segments embedded in epoxy as described below.

In one implementation, the reinforcing structure 130 includes a single piece of pre-impregnated fiber matrix 305. The piece of pre-impregnated fiber matrix 305 is vertically oriented along an axis of the fuse 100, and is sufficiently wide to cover all or the majority of the outer surface of the fuse 100.

In another implementation, the reinforcing structure 130 includes a mixture of fiber segments embedded in a resin. The fiber segments may be of a uniform length or may include fibers of varying lengths. The orientation of the fiber segments may be a predetermined orientation or an arbitrary orientation. The fuse 100 is at least partially coated with the mixture, using coating techniques such as, for example, dipping or powder coating. The reinforcing structure 130 may reinforce the entire length or only a pre-selected portion of the fuse 100.

In another implementation, the support structure 130 may be a pre-formed tubular structure, and may be made of a composite material. The pre-formed tubular structure may be slit from one end to the other end in order to facilitate the assembly process.

In yet another implementation, the reinforcing structure 130 may be a fiber matrix that is impregnated with resin during the fuse manufacturing process. For example, a fiber matrix may be impregnated with resin immediately prior to application to the fuse 100.

Figure 4:
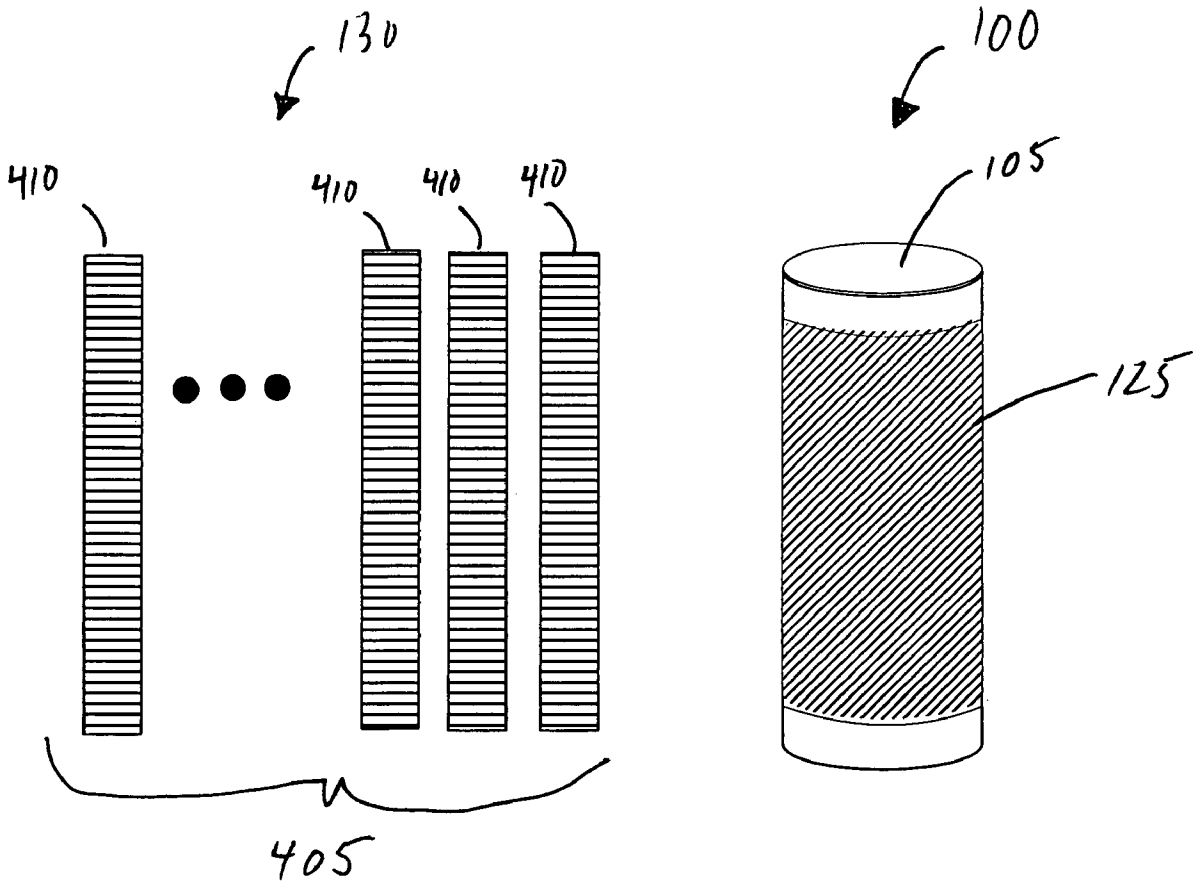

FIG. 4 shows another implementation of the application of the reinforcing structure 130 to the support structure 125. As shown in FIG. 4, a collection 405 of strips 410 of a pre-preg material are used to form the reinforcing structure 130. The strips 410 typically are applied to the support structure 125 at regular intervals, and typically are applied so as to cover the entire surface of the support structure 125. In another implementation, the reinforcing structure is applied so as to reinforce a pre-selected portion of the fuse 100.

The strips 410 are placed in a vertical orientation along an axis of the fuse 100. The strips 410 are applied in one or more vertical layers to form reinforcing structure 130 so as to have a predetermined thickness. The vertically-applied matrix may be applied circumferentially or may be combined with other patterns, such as, for example, the circumferentially-applied matrix and/or the fiber segments embedded in epoxy.

In another implementation, the reinforcing structure 130 may be applied as a coating. For example, the reinforcing structure 130 may be applied as a coating of fiber segments mixed in resin.

Referring again to FIG. 2, in one implementation, the heat shrink structure 135 is applied over the reinforcing structure 130. The heat shrink structure 135 assists with the removal of air entrapped within the reinforcing structure 130 during curing of the reinforcing structure 130. The heat shrink structure 135 also provides sufficient UV stability to eliminate the requirement for a UV painting operation. In particular, the heat shrink structure 135 applies pressure to the reinforcing structure 130 as that structure is cured, and thereby forces out any air pockets in the reinforcing structure 130 or between the support structure 125 and the reinforcing structure 130. In another implementation, a UV resistant paint is applied to the reinforcing structure 130.

Figure 5:
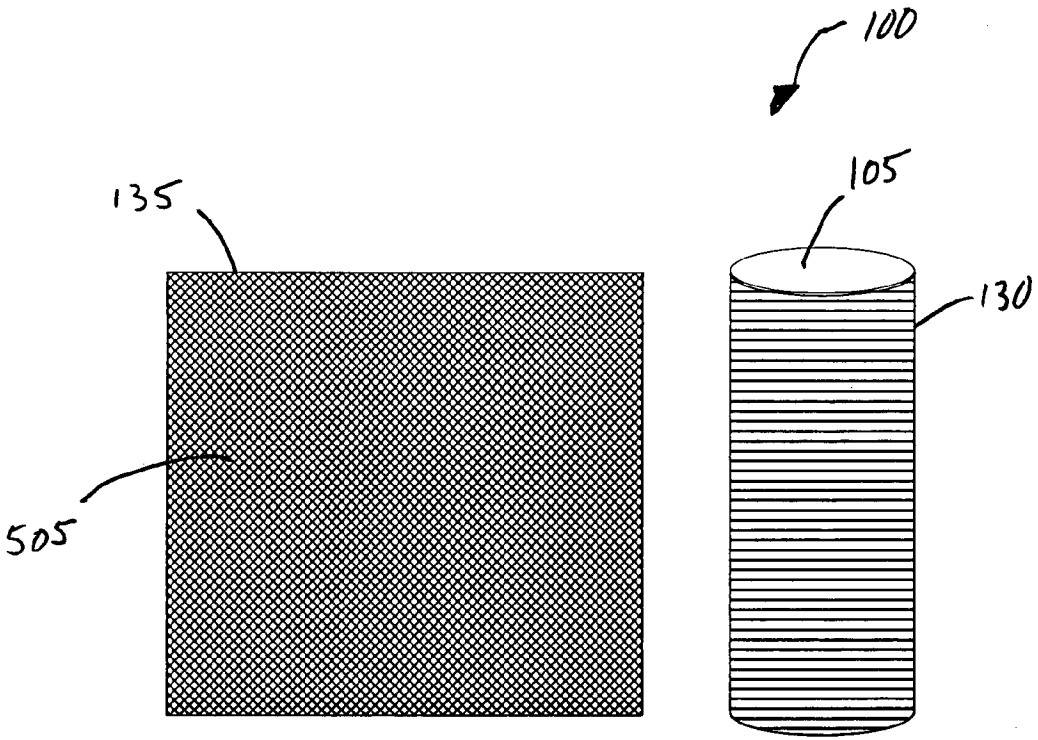
FIGS. 5 and 6 are plan views of heat shrink structures applied to the fuse of FIG. 1.

FIG. 5 shows one approach to applying the heat shrink structure 135 layer to the reinforcing structure 130. As shown in FIG. 5, the reinforcing structure 130 is surrounded by the heat shrink structure 135. In one implementation, the heat shrink structure 135 is a pre-formed tube of heat shrink material that fits over the reinforcing structure 130. In another implementation, the heat shrink structure 135 is a sheet of heat shrink material 505 that is wrapped around the reinforcing structure 130 in a winding operation.

Figure 6:
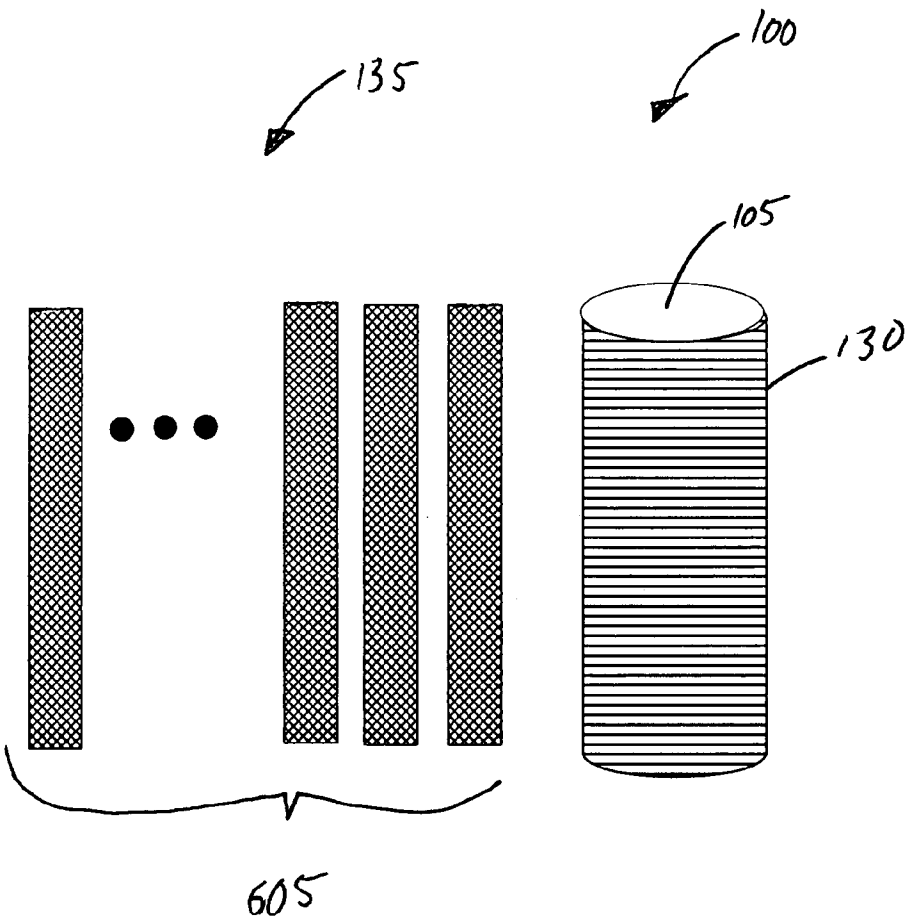

FIG. 6 shows another approach to applying the heat shrink structure 135 to the reinforcing structure 130. As shown in FIG. 6, multiple strips 605 of heat shrink material are applied to the reinforcing structure 130. Typically, the strips 605 of heat shrink material are placed so as to cover the outer surface of the reinforcing structure 130. The heat shrink structure 135 assists with air bubble removal from the reinforcing structure 130, and also assists with the provision of UV Protection.

Referring once more to the implementation illustrated by FIG. 2, the reinforcing structure 130 is in the form of a sheet of pre-preg material and the heat shrink structure 135 is in the form of a tube of heat shrink material. During assembly, a warming process heats the sheet of pre-preg material to approximately 300° F. for approximately 30 seconds. A rolling process then is used to apply the sheet of pre-preg material to the support structure 125. The rolling operation typically takes approximately 10 seconds or less. Next, the support structure 125 and the wrapped sheet of material are inserted into the tube of heat shrink material, and the components of the assembled fuse 100 are cured together for approximately one hour at approximately 255° F. Other curing times and temperatures may be used, depending upon the requirements of the material used for the reinforcing structure 130 and the heat shrink structure 135. The curing temperature causes the epoxy resin in the pre-preg material to become viscous, and also causes the heat shrink material to shrink. While and after shrinking, the heat shrink material applies a constrictive force to the viscous epoxy resin and thereby forces out any air trapped in the sheet of material or between the sheet of material and the support structure, forcing viscous epoxy to properly penetrate over the side of the contact surface. After curing, the epoxy resin hardens to form the solid reinforcing structure 130.

In the curing process, the shrinking of the heat shrink structure 135 occurs at approximately the same time as the curing process of the reinforcing structure 130. The curing process may be carried out in a conventional oven or a specialty device such as a channel oven, or by using other appropriate methods and equipment, such as a forced air heat gun.

In other implementations, the heat shrink structure 135 is applied as a wrap of heat shrink material or as a series of strips of heat shrink material, rather than as a pre-formed tube of heat shrink material. Additionally, a self-amalgamating heat shrink tape may be used as the heat shrink structure 135.

Figure 7:
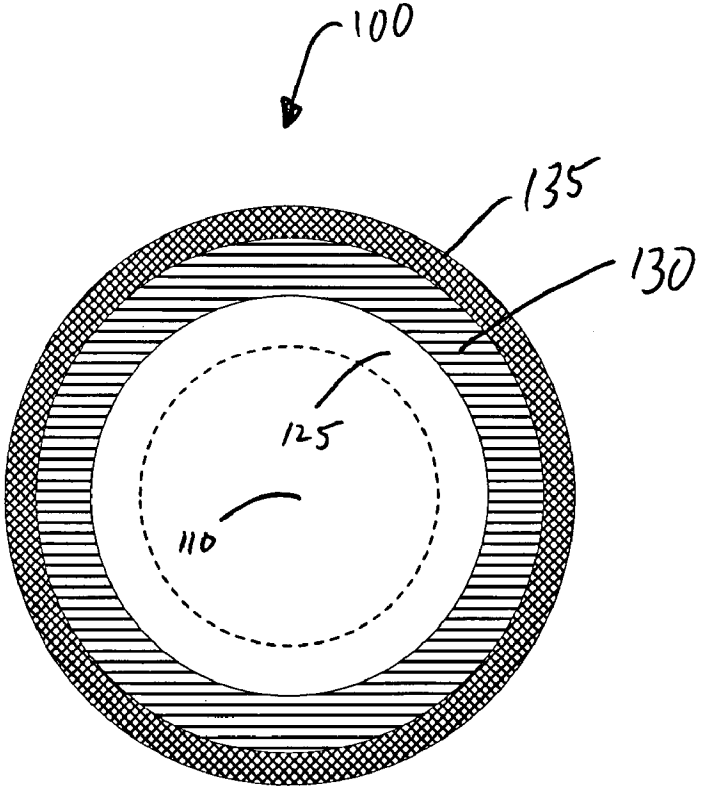
FIG. 7 is an end view of the fuse of FIG. 1.

FIG. 7 shows an end view of the fuse 100 of FIGS. 1 and 2. In particular, FIG. 7 shows that an electrical contact 110, the support structure 125, the reinforcing structure 130, and the heat shrink structure 135 are arranged in concentric layers. Although the position of the support structure 125 layer is indicated, the support structure 125 itself is not visible in FIG. 7 because the reinforcing structure 130 is formed over the support structure 125 and is in direct physical contact with an outside surface of the electrical contact 110.

Figure 8:
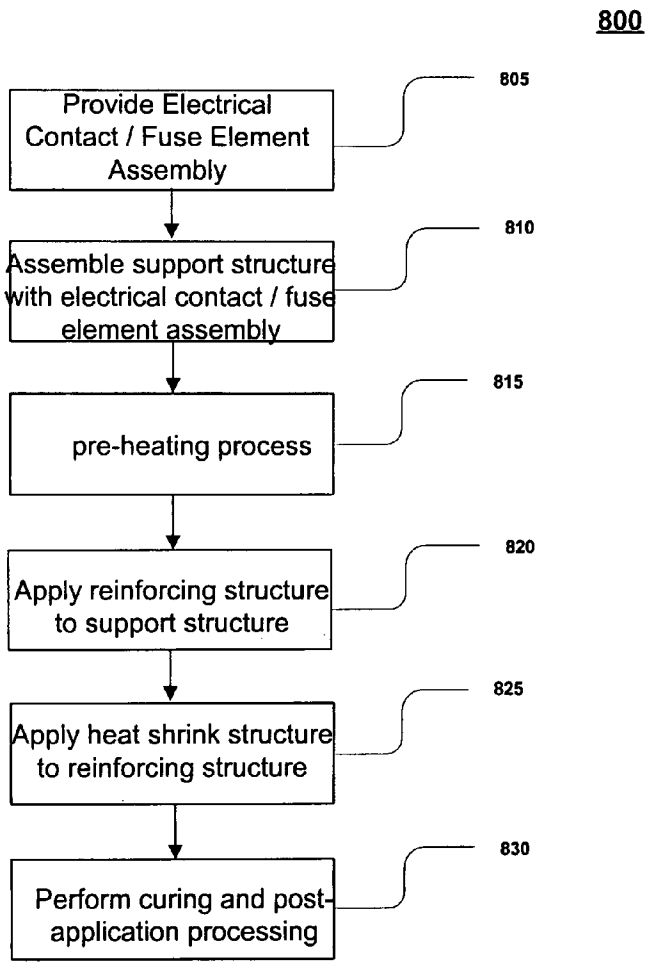
FIG. 8 is a flow chart of a method of producing the fuse of FIG. 1.

FIG. 8 shows a process for producing the fuse 100 of FIG. 1. As shown and described with respect to FIGS. 1-3, an electrical contact/fuse element assembly 105 is provided (step 805).

Next, as described with respect to FIG. 2, the support structure 125 is assembled together with the electrical contact/fuse element assembly 105 (step 810).

Then, as described with respect to FIG. 2, a pre-heating process is performed for the support structure 125 and electrical contact/fuse element assembly 105 (step 815). In general, the fuse is heated to a temperature that is sufficient to cause the resin in the pre-impregnated fiber matrix to become tacky or melt. The temperature can be varied to adjust the tackiness, viscosity, or flowability of the resin as desired during the fabrication of the fuse 100.

The electrical contact/fuse element assembly is heated to between approximately 100° F. and approximately 200° F., and more particularly to between approximately 150° F. and approximately 180° F. For example, in one implementation, the assembly is heated to approximately 170° F. using, for example, an oven or a forced air heat gun.

Next as described with respect to FIGS. 2-4, the reinforcing structure 130 is applied to the support structure 125 (step 820). In one implementation, described with respect to FIG. 3, applying the reinforcing structure 130 includes applying the pre-cut, pre-impregnated material 305 to the support structure 125 in a rolling operation.

Then, as described with respect to FIGS. 2, 5, and 6, the heat shrink structure 135 is applied to the reinforcing structure 130 (step 825). In one implementation, the heat shrink structure 135 is a tube that is placed over the fuse tube assembly 120.

Finally, as described with respect to FIG. 2, the curing and post-application processing is performed (step 830). After curing, the assembly at the current limiting fuses is complete.

The post-application processing may include contemporaneous curing of the resin and heating of the shrink material, such as by heating the fuse to between approximately 250° F. and approximately 400° F. for approximately 60 minutes to approximately 120 minutes. The heating may be performed in an oven, such as a channel oven, or by the use of a forced air heat gun or by other suitable methods. After curing, the fuse with the mechanical reinforcement structure 100 is ready to be filled with the arc quenching medium and other steps in completing the production process as appropriate.

Other implementations are within the scope of the following claims.

What is claimed is:

1. A method of reinforcing a fuse, the method comprising:

providing an electrical assembly, the electrical assembly comprising two electrical contacts accessible from an exterior of a fuse and a fuse element in contact with the two electrical contacts;

surrounding at least a portion of the electrical assembly by a pre-formed tubular support structure;

after surrounding at least a portion of the electrical assembly by the pre-formed tubular support structure, applying a reinforcing structure over the pre-formed tubular support structure and in contact with at least a portion of the electrical assembly, wherein the reinforcing structure comprises a fiber matrix, the fiber matrix comprising fibers pre-impregnated with a resin.

2. The method of claim 1 further comprising applying a heat shrink structure over the reinforcing structure.

3. The method of claim 1 wherein applying the reinforcing structure comprises applying the pre-impregnated fiber matrix in a rolling operation.

4. The method of claim 1 wherein applying the reinforcing structure comprises applying the pre-impregnated fiber matrix in a wrapping operation.

5. The method of claim 1 wherein applying the reinforcing layer comprises circumferentially applying the pre-impregnated fiber matrix.

6. The method of claim 1 wherein applying the reinforcing layer comprises vertically applying the pre-impregnated fiber matrix.

7. The method of claim 1 further comprising performing post application processing of the fuse.

8. The method of claim 7 wherein performing post application processing comprises curing.

9. The method of claim 8 wherein curing the reinforcing fuse comprises heating the fuse.

10. The method of claim 9 wherein the fuse is heated to between 250° F. and 400° F.

11. The method of claim 1 further comprising pre-heating the electrical assembly.

12. The method of claim 11 wherein the electrical assembly is pre-heated to between 100° F. and 200° F.

13. The method of claim 1 further comprising filling the fuse with an electrical arc quenching medium.

* * * * *